United States Patent [19]

Kourimsky et al.

[11] 4,268,731

[45] May 19, 1981

[54] ELECTRICAL SWITCH

[75] Inventors: Josef A. Kourimsky, Bensheim; Lothar H. W. Nix, Walldorf, both of Fed. Rep. of Germany

[73] Assignee: AMP Incorporated, Harrisburg, Pa.

[21] Appl. No.: 18,008

[22] Filed: Mar. 7, 1979

[30] Foreign Application Priority Data

Mar. 8, 1978 [GB] United Kingdom ..... 9106/78

[51] Int. Cl.[3] ..... H01H 1/16; H01H 21/40; H01H 3/00

[52] U.S. Cl. ..... 200/67 AA; 200/61.85; 200/73; 200/277; 200/339

[58] Field of Search ..... 200/277, 284, 339, 258, 200/259, 73, 74, 68, 67 AA, 61.85, 61.59

[56] References Cited

U.S. PATENT DOCUMENTS

| | | | |
|---|---|---|---|
| 3,792,210 | 2/1974 | O'Dea et al. | 200/61.59 |
| 3,958,090 | 5/1976 | Garcia | 200/67 AA |
| 3,971,905 | 7/1976 | Delaage | 200/77 |
| 4,031,345 | 6/1977 | Garcia | 200/67 AA |
| 4,081,641 | 3/1978 | Piber | 200/277 X |

FOREIGN PATENT DOCUMENTS

| | | |
|---|---|---|
| 1482039 | 5/1967 | France . |
| 2358740 | 7/1977 | France . |
| 545567 | 6/1942 | United Kingdom . |
| 1126223 | 9/1968 | United Kingdom . |

*Primary Examiner*—Gene Z. Rubinson
*Assistant Examiner*—Richard M. Moose
*Attorney, Agent, or Firm*—David C. Ripma; Jay L. Seitchik

[57] ABSTRACT

An electrical switch comprises a pair of spaced terminals, fixed in an insulating housing; a metal roller; and, a finger-piece for moving the roller between first and second switching positions engaging only one and both terminals respectively. The one terminal is resiliently flexed to bias the roller against the second terminal in the second switching position. The one terminal comprises a cantilever spring having an upset end protruding into the roller path and providing the fulcrum for an overcenter action biassing the roller in either switching position.

5 Claims, 3 Drawing Figures

ELECTRICAL SWITCH

The invention relates to an electrical switch.

It is desirable to provide an electrical switch which is reliable in operation and yet relatively inexpensive to manufacture.

A known switch comprises a pair of terminals, fixed spaced apart from each other in an insulating housing; a metal roller; and, a finger-piece of insulating material having a cavity receiving the roller and mounted in the housing to move the roller between a first and a second switching position in which the roller engages only one and both terminals respectively.

A disadvantage of the known switch is that additional means are required to bias the roller against the contacts to ensure a reliable electrical connection.

According to the invention, the one terminal is resilient, the arrangement being such that the one terminal is resiliently flexed to bias the roller against the terminal in the second switching position.

Resilient flexure of the one terminal may therefore provide the force necessary to establish electrical contact between the roller and both terminals in the second switching position obviating need for additional biassing means to maintain reliable electrical connection between the roller and the contacts.

The arrangement may be such that the engagement between the roller and the or each terminal respectively, traps the roller in the cavity in first and second switching positions facilitating simplicity of manufacture and assembly of the switch.

Preferably, increased resilient deformation of the one terminal is produced during roller movement providing an overcentre action, biassing the roller toward respective switching positions relative to the one terminal.

The roller may be received as a free fit in the cavity to permit limited movement of the roller in the switching direction independently of the finger-piece. The switching speed may be increased as the roller may be of small mass with consequential reduction in risk of arcing.

The one terminal may comprise a cantilever spring extending in the direction of roller movement and having a transverse roller engaging portion protruding into the path of the roller movement and providing the fulcrum for the overcentre action.

Preferably, the finger-piece is mounted in the housing for rocking movement to effect switching and includes a channel section portion into which roller engaging portions of the terminals extend, the roller being received in aligned slots in the channel walls.

A specific example of a switch according to the invention will now be described with reference to the accompanying drawings in which.

Figure 1:
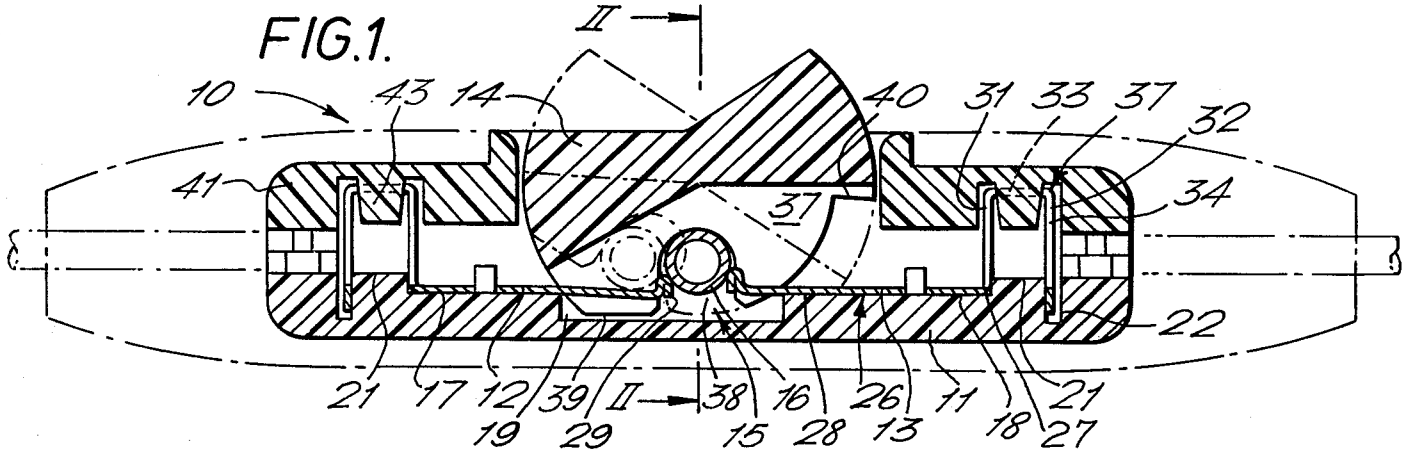
FIG. 1 is a cross-sectional view in a plane transverse to the roller axis.
Figure 3:
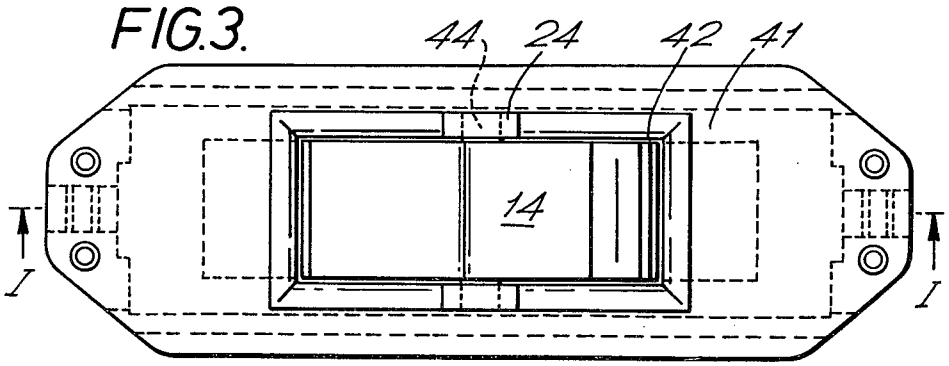
FIG. 3 is a plan view.
Figure 2:
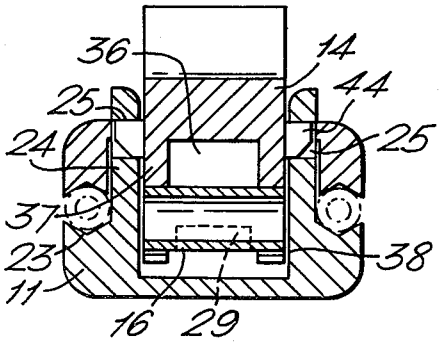
FIG. 2 is a cross-sectional view in a plane through the roller axis.

The switch comprises an insulating housing 10 a pair of terminals 12 and 13 respectively, fixed spaced apart in the housing and a metal roller 16 received in a cavity 15 in a finger-piece 14 mounted in the housing for rocking movement to move the roller between a first and a second switching position engaging one and both terminals, respectively.

The housing comprises a base 11 and a cover 41 each moulded in one piece from plastics material. The base 11 is of generally channel-section the floor of the channel being stepped longitudinally to define a first pair of terminal supporting beds 17 and 18, respectively, on opposite sides of a central recess 19, and a second pair of beds 21 having transverse slots 22. The terminal supporting bed 17 is shorter than the bed 18 for reasons explained below. The walls of the channel section are rebated to provide wire supporting ledges 23. Post portions 24 upstand from a central location of each side wall and have apertures 25 towards their upper ends providing sockets of a trunnion mounting for the finger-piece.

The cover 41 has a central aperture 42 for receiving the posts 24 and the finger-piece, wire engaging portions 43, and longitudinally extending shoulders forming part of wire supporting ledges 23 on opposite sides for co-operation with the shoulders on the base to grip wires when the cover is mounted on the base.

Each terminal 12 and 13 is stamped and formed in one piece and has a contact portion 26 extending from a wire connecting portion 27. Each contact portion comprises a resilient tongue 28 upset and folded transversely at its free end to provide a nose 29. Each wire-connecting portion 27 comprises a pair of parallel plates 31 and 32 respectively, joined together at one end by a web 33 extending transversely from each plate, a wire-receiving slot 34 extending through the bight into each plate.

The finger-piece 14 is moulded from plastics material in generally disc shape having an internal recess 36 of sectorial cross-section in the disc plane and defining a portion of channel axial cross-section. Opposite walls 37 of the channel section portion are formed with aligned roller receiving slots 38 extending radially into the walls and shoulders 39 and 40 respectively at opposite circumferential ends. Trunnions 44 extend axially from opposite sides of the finger-piece.

The switch is assembled by mounting the terminals in the base channel so that their contact tongues 28 are supported by the beds 17 and 18 and the free ends of the plates 32 of the wire connecting portions are respectively received in the slots 22. As the bed 17 is shorter than the bed 18, the tongue of terminal 12 will provide a cantilever spring arm of greater effective length than the tongue of terminal 13 and therefore be of greater flexibility than the tongue of terminal 13.

The roller is then located on the terminal noses and the finger-piece applied to the housing base with the trunnions received as a snap-fit in aperture 42 so that the roller is located in the slots 38.

Wires are then aligned with each terminal slot 34 and pushed simultaneously into the slots by portions 43 during the application of the cover to the base so that the edges of each slot effects permanent electrical connection to the conductive wire cores. The beds 21 ensuring that the plates 31 and 32 remain parallel during insertion. When provided, auxiliary wires are located on ledges 23. The cover can be welded or otherwise bonded to the base. The entire assembly may then be inmoulded to provide a switch of oval cross-section.

Operation of the finger-piece moves the roller between first and second switching positions in which it engages only the terminal 12 and both terminals 12 and 13 respectively. During movement between switch positions the roller rides over the nose of terminal 12 increasing the resilient deformation of the terminal which biasses the roller to either switch position when the roller passes an overcentre condition, increasing the speed of switching. It should also be noted that the roller is received as a free fit in the slots 38 to permit limited movement in the switching direction independent of the finger-piece. This increases the switching speed as the inertia of the finger-piece need not be overcome during initial stages of engagement between the roller and the terminal 13. A self-centering action is also present. Movement of the finger-piece is limited by the shoulders 39 and 40 engaging the flow of the base channel.

The switch described may be manufactured and assembled economically using mass production techniques and needs few different parts while providing a fast switching action.

In an alternative example (not shown), the cover member and the base member are provided with complementary latching means engageable as a snap fit on the application of the cover to the base to force the wires into the slots. The base may have resiliently flexible posts upstanding therefrom with latching heads at their free ends receivable on flexure of the posts in latching apertures provided in the cover. The trunnions are trapped between the cover member and the base member instead of being received in sockets 25. This facilitates assembly of the switch by mass production techniques.

What is claimed is:

1. An electrical switch comprising a pair of terminals, fixed spaced apart from each other in an insulating housing; a metal roller; a finger-piece of insulating material having a cavity receiving the roller between a first and a second switching position in which the roller engages only one and both terminals respectively and wherein engagement between the roller and either terminal traps the roller in the cavity in said first and second switching positions, the one terminal being resilient and including a cantilever spring extending in the direction of roller movement, said one terminal having a transverse roller engaging portion protruding into the path of the roller movement to produce an overcenter action which biases the roller toward respective switching positions relative to the one terminal as said roller moves and resiliently deforms said one terminal, said roller engaging portion providing the fulcrum for the overcenter action, and the roller being received as a free fit in the cavity to permit limited movement of the roller in the switching direction independently of the finger-piece, the arrangement being such that the one terminal is resiliently flexed to bias the roller against the second terminal in the second switching position.

2. An electrical switch as in claim 1 in which the finger-piece is mounted in the housing for rocking movement to effect switching and includes a channel section portion into which roller engaging portions of the terminals extend, the roller being received in aligned slots in the channel walls.

3. An electrical switch as in claim 1 in which the housing comprises a base member and a cover member and each terminal comprises a wire engaging portion with a wire receiving slot integrally formed with a roller engaging portion each terminal being fixed on the base member with the slotted portion upstanding from the base member, wire engaging portions being provided on the cover member in alignment with the slotted portions so that application of the cover member to the base member forces wires located between the wire engaging portions and the slotted portions into the slots to establish electrical connection with the respective wires.

4. An electrical switch according to claim 3 in which the operating member is provided with trunnions received in a snap action in sockets provided in the base member.

5. An electrical switch comprising: an insulating housing including a base having flat terminal supporting surfaces on opposite sides of a recess, first and second terminals each stamped and formed from a single piece of sheet metal stock and having a resilient strip-like body portion, a wire connecting portion and a contact portion formed at respective opposite ends of the body portion, each contact portion being defined by a roller engaging portion extending transversely of and perpendicularly to the plane of the strip, the terminals being located in mutual alignment on opposite sides of the recess with said strip-like body portions supported by said terminal supporting surfaces and protruding cantilever fashion over the recess, said roller engaging portions being located mutually spaced apart over the recess and extending away from the base, said first terminal protruding further over the recess than said second terminal to provide a resilient cantilever spring, a finger-piece of insulating material formed with a cavity therein, a metal roller received in the cavity having a free fit in a switching direction to permit limited movement of the roller in the switching direction independently of the finger-piece, and means for mounting said finger-piece in the housing for movement together with said roller between first and second switching positions in which the roller engages only one and both terminals respectively, such that said first terminal is resiliently flexed to bias said roller against said second terminal in the second switching position, said roller engaging portion on the first terminal providing a fulcrum for an overcenter action produced by increased resilient flexure of the first terminal during roller movement between said first and second switching positions thereby biasing the roller towards the respective switching positions.

* * * * *